US008683689B2

(12) United States Patent
Deron et al.

(10) Patent No.: US 8,683,689 B2
(45) Date of Patent: Apr. 1, 2014

(54) METHOD FOR MANUFACTURING CONSTITUENTS OF A HOLLOW BLADE BY PRESS FORGING

(75) Inventors: Christine Deron, La Celle Saint Cloud (FR); Alain Georges Henri Rene Lorieux, Sannois (FR); Philippe Rene Georges Joffroy, Viarmes (FR); Jean-Louis Paul Victor Despreaux, Paris (FR)

(73) Assignee: SNECMA, Paris (FR)

( * ) Notice: Subject to any disclaimer, the term of this patent is extended or adjusted under 35 U.S.C. 154(b) by 1564 days.

(21) Appl. No.: 11/207,767

(22) Filed: Aug. 22, 2005

(65) Prior Publication Data

US 2007/0240307 A1 Oct. 18, 2007

(30) Foreign Application Priority Data

Aug. 23, 2004 (FR) ..... 04 51885

(51) Int. Cl.
*B21D 53/78* (2006.01)

(52) U.S. Cl.
USPC ..... 29/889.72; 29/889.7

(58) Field of Classification Search
USPC ..... 29/889.7, 889.72, 889.721, 421.1; 72/352, 353.2, 353.6, 354.2, 360; 416/212 R; 228/136, 164
See application file for complete search history.

(56) References Cited

U.S. PATENT DOCUMENTS

| | | | | |
|---|---|---|---|---|
| 4,970,887 | A * | 11/1990 | Lorieux | 72/356 |
| 5,000,368 | A * | 3/1991 | Turner | 228/131 |
| 5,636,440 | A | 6/1997 | Bichon et al. | |
| 5,711,068 | A | 1/1998 | Salt | |
| 5,826,332 | A | 10/1998 | Bichon et al. | |
| 5,933,951 | A | 8/1999 | Bergue et al. | |
| 5,933,952 | A | 8/1999 | Bichon et al. | |
| 6,210,630 | B1 * | 4/2001 | Bergue et al. | 266/96 |
| 6,418,619 | B1 * | 7/2002 | Launders | 29/889.7 |
| 6,467,168 | B2 * | 10/2002 | Wallis | 29/889.721 |
| 6,739,049 | B2 * | 5/2004 | Nicholson | 29/889.72 |
| 7,526,862 | B2 * | 5/2009 | Leveque et al. | 29/889.7 |

OTHER PUBLICATIONS

Human translation of JP01-289531A, Watanabe, "Superplastic Forging Method", Nov. 21, 1989.*
Patent Abstracts of Japan, JP 01-289531, Nov. 21, 1989.
Patent Abstracts of Japan, JP 02-080149, Mar. 20, 1990.
Patent Abstracts of Japan, JP 01-258839, Oct. 16, 1989.

* cited by examiner

*Primary Examiner* — David Bryant
*Assistant Examiner* — Ryan J Walters
(74) *Attorney, Agent, or Firm* — Oblon, Spivak, McClelland, Maier & Neustadt, L.L.P.

(57) ABSTRACT

A method for manufacturing a hollow blade for a turbomachine is disclosed in which the blade is manufactured using a preform derived from external primary parts. A primary part including a root portion is formed by upset forging a bar in which material has been forced into a large volume area. Finish forging is done in at least two complementary stamping operations using an intermediate blank in order to limit costs and to use mechanical presses even for large and thin primary parts. Dies for forging the primary part are defined so as to double up at least the forging capacity of a press.

17 Claims, 6 Drawing Sheets

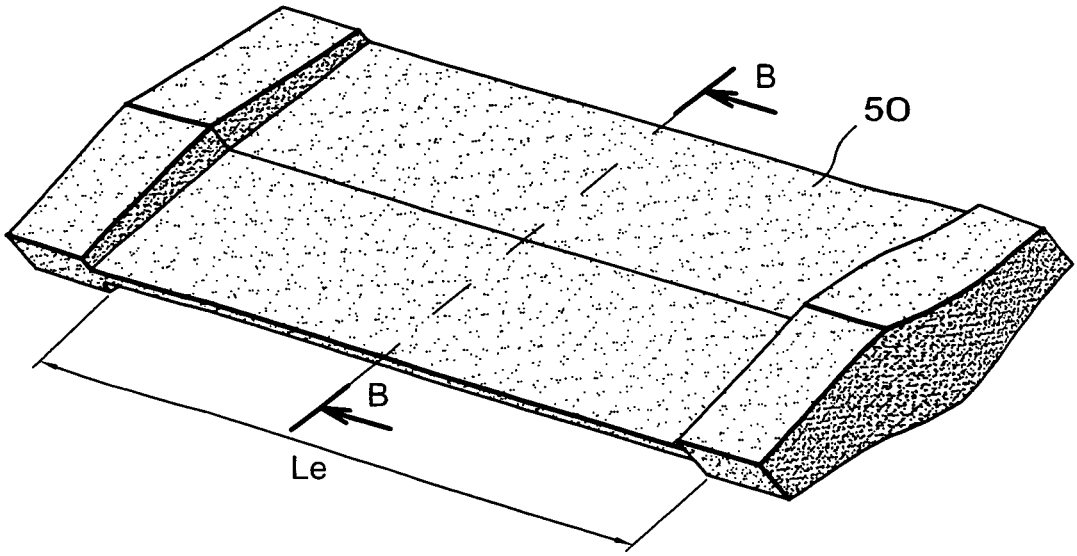
FIG. 5A
FIG. 5B
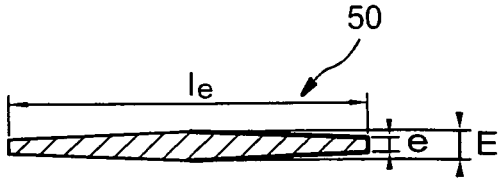
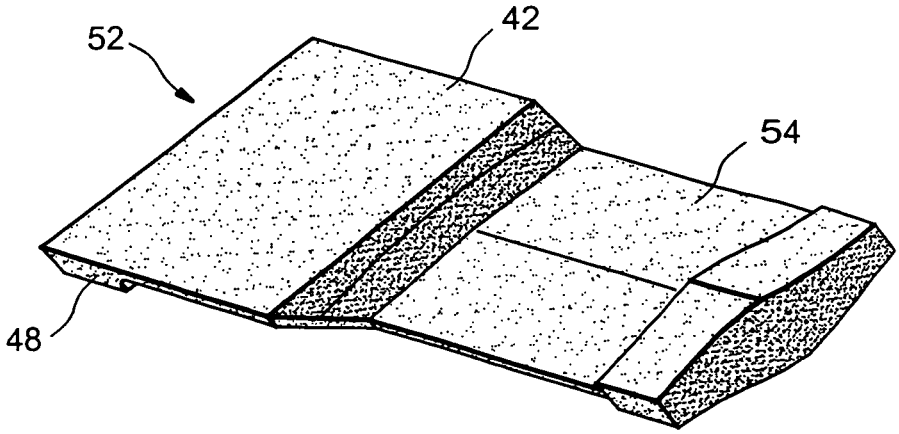
FIG. 6A

METHOD FOR MANUFACTURING CONSTITUENTS OF A HOLLOW BLADE BY PRESS FORGING

TECHNICAL FIELD

This invention relates in general to the field of methods for manufacturing of turbomachine blades, such as hollow fan blades or any other type of rotor or stator blade for a turbomachine or propulsion system.

STATE OF PRIOR ART

A hollow fan blade for a turbomachine normally comprises a relatively thick root used to fix this blade into a rotor disk, this root being extended radially outwards by a thin aerodynamic part called the blade airfoil.

Prior art (for example see U.S. Pat. No. 5,636,440), describes a method for manufacturing such a hollow blade based mainly on use of the diffusion bonding technique combined with the superplastic forming technique. In this method according to prior art, two or three constituents of the blade are defined first of all and are then made separately before being superposed and assembled to each other using the diffusion bonding technique in order to obtain a required blade preform.

The next step is to create the aerodynamic profile of the previously manufactured preform, and then inflation of this preform by applying gas pressure and superplastic forming of this preform so as to create a blade in approximately its final shape before terminal machining.

As mentioned above, manufacturing of the blade preform includes a step to produce at least two external parts. Typically, external parts are made by machining of procured elements. Each of the two machined external parts has two radially opposite portions with very different thicknesses: the thick root part is used to fix the blade in the rotor disk, and the thin aerodynamic airfoil part extends from the root part towards the radially external end.

Different techniques have been used to manufacture these external parts. For example, document U.S. Pat. No. 5,711,068 describes a method consisting of producing parallelepiped-shaped parts from a metallic material longer than the preform from the root part to the airfoil part, with a thickness similar to the thickness of the root part. Each parallelepiped is then cut obliquely so as to form two distinct panels with a longitudinally tapering thickness. This method is complex to implement and the limiting maximum thickness is quickly reached, and additional elements are conventionally added to form the root of the blade.

Document U.S. Pat. No. 5,636,440 describes a technique for upset forging a metal bar by forcing material into a large volume area from which the root will be made. The primary part consisting of a forged bar is then machined. However, this embodiment is limited by the power of existing production means, particularly for external primary parts intended for manufacturing of large blades.

Therefore considering the thickness variations, manufacturing of external parts that will at least partially form the preform of the blade is the cause of losses of material that can generate high costs, and difficult machining techniques, such that the hollow blade manufacturing method is not fully optimized.

DISCLOSURE OF THE INVENTION

The purpose of the invention is to propose a manufacturing method for a hollow blade for a turbomachine at least partially correcting the disadvantages mentioned above.

More precisely, according to one of its aspects, the invention relates to a method for manufacturing a hollow blade wherein the step to manufacture external parts of the blade preform is such that large blades can be made minimizing material losses and using more or less conventional and well proven machining techniques, for which manufacturing costs are not significantly higher than for methods according to prior art.

In particular, the invention relates to a method of manufacturing primary parts by die forging. According to the invention, this forging is done in at least two successive complementary steps for finish forging, in other words the forging step in which the primary part itself is made.

The primary part manufactured by the method according to the invention may be in the general shape of a plate with a thickness to width ratio of less than 0.03, or even 0.025. Forging is preferably done from a bar, with an intermediate step consisting of fabrication of a blank for which the cross-section is optimized for the power of the press. Advantageously, each forging step is done using a mechanical press.

According to the invention, fabrication of primary parts is integrated into a method for fabrication of a hollow blade for a turbomachine including the root and airfoil, and preferably made by diffusion bonding and superplastic forming.

Another aspect of the invention relates to a set of dies adapted to die forging of a primary part in several stamping operations, including at least one first die in which only part has a shape complementary to the primary part, the other part corresponding to the initial blank, and a second die corresponding to the primary part itself. The connection area between the two parts of the first die is defined by parameters so as to optimize the resulting primary part, not requiring any intense machining and/or not causing excessive loss of material.

BRIEF DESCRIPTION OF THE DRAWINGS

The characteristics and advantages of the invention will be better understood after reading the following description with reference to the attached drawings given for illustrative purposes and in no way limitative, in which:

FIG. 6A shows the product derived from an intermediate step in the finish forging phase according to the invention.

DETAILED DISCLOSURE OF PARTICULAR EMBODIMENTS

Figure 1:
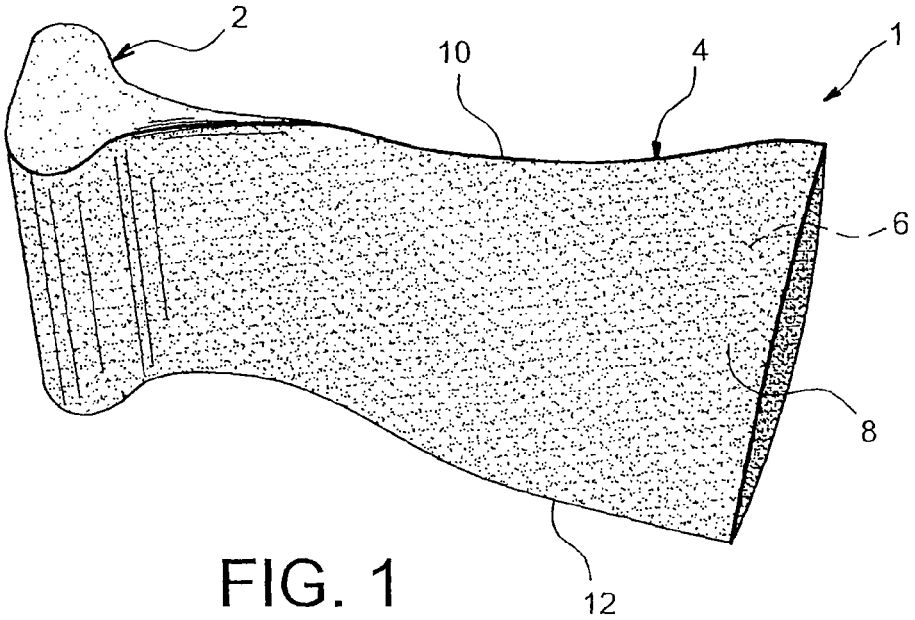
FIG. 1 BACKGROUND ART
FIG. 1 shows a conventional turbomachine hollow blade.

FIG. 1 shows a hollow blade 1, of the large chord fan rotor blade type, for a turbomachine (not shown). The geometry of this type of blade is complicated; for example it may be made from titanium or a titanium alloy such as TA6V, and it comprises a root 2 prolonged by an airfoil 4 in a radial direction. The airfoil 4 will be placed in the circulating flowpath of an airflow through a turbomachine, and is fitted with two external surfaces called the extrados surface 6 and the intrados surface 8, connected through a leading edge 10 and a trailing edge 12.

This type of complex profile for a hollow blade is preferably made using the SPF/DB <<Super Plastic Forming/Diffusion Bonding>> technique.

Figure 2:
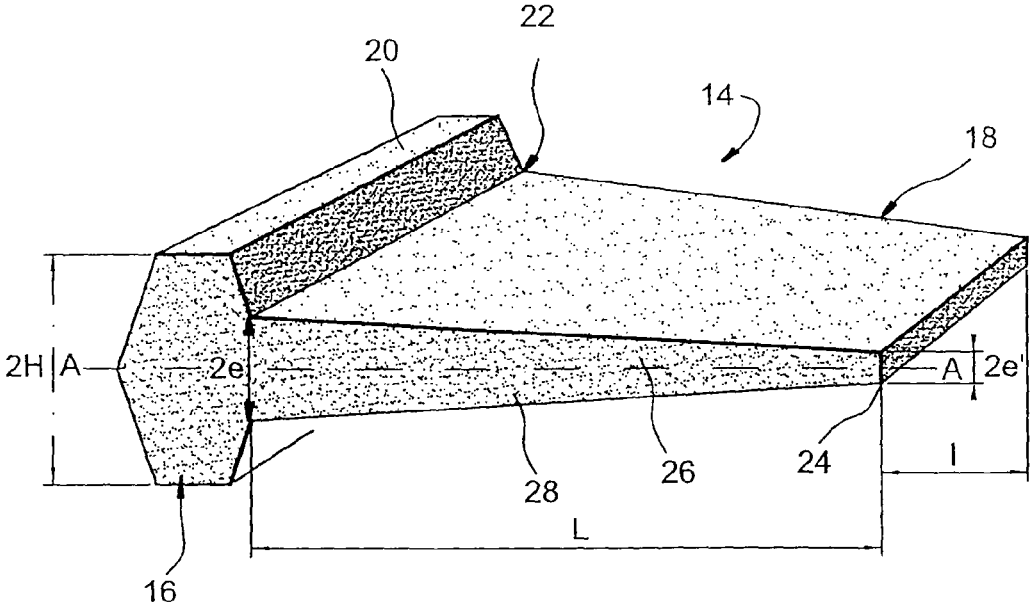
FIG. 2 shows a blade preform like that obtained after diffusion bonding or as modeled to define the primary parts.

Regardless of what method is used, the first step consists of modeling the profile of the blade 1 to obtain a preform that can be manufactured by welding primary parts: the intrados wall 8 and the extrados wall 6 or their graphic representation are in contact on the same plane. This operation may be done by simulation using CAD (Computer Aided Design) means, for example consisting of deflation followed by untwisting and straightening, in order to obtain a preform 14 like that shown in FIG. 2.

This preform 14 with an average length L and width 1 comprises a root part 16 that is extended in a radial direction by an airfoil part 18. As can be seen on this FIG. 2, the root part 16 is provided with an internal portion 20 that has a high average thickness 2H, and will subsequently be used to fix the blade in a rotor disk of the turbomachine.

The airfoil part 18 of the preform 14 is provided with a radially internal end 22 with a thickness 2*e* and a radially external end 24 with a thickness 2*e*', usually less than the thickness 2*e*. However, the thickness of the airfoil part 18 of the preform 14 is approximately uniform over its length L.

In order to make the preform 14 (which for a hollow blade 1 must be inflatable and therefore cannot be composed of a single block), primary parts will be defined that will be fixed to each other. Primary parts can be defined in different ways starting from block 14, the most obvious way being a longitudinal section along the AA axis to form at least two external primary parts 26, 28.

The profiles of the primary parts 26, 28 thus defined are complex, particularly with a root part with a thickness H and a long airfoil part with a thickness varying from e to e'.

According to the invention, the die forging and machining techniques will be used to make such a primary part.

Figure 3A:
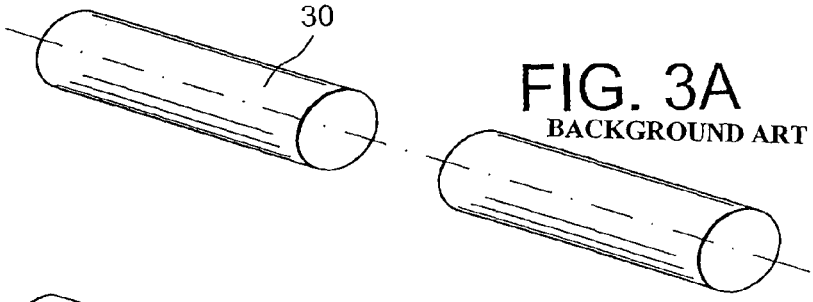
FIG. 3A BACKGROUND ART
FIGS. 3A-3D show a method for die forging of a primary part, FIG. 4 show a primary part that can be forged using a method according to the invention, FIG. 5 show a blank for forging a primary part using a method according to the invention, for example starting from a bar.
Figure 3B:
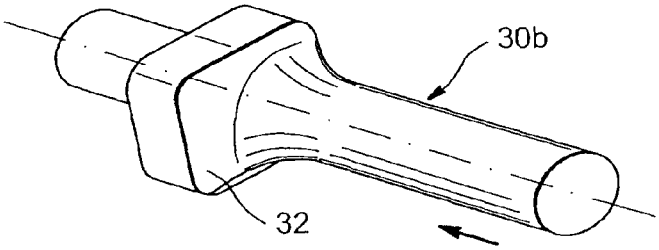
FIG. 3B BACKGROUND ART
Figure 3C:
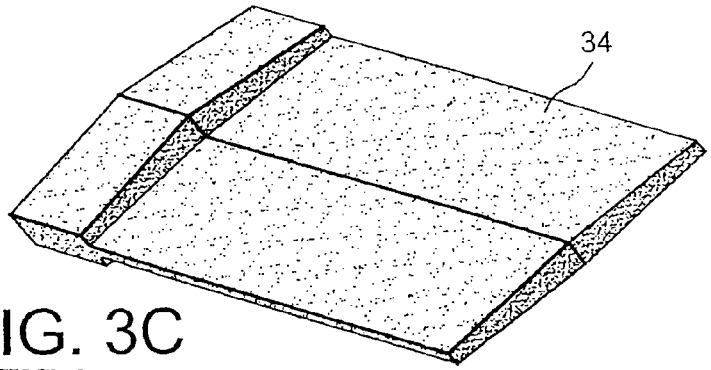
FIG. 3C BACKGROUND ART
Figure 3D:
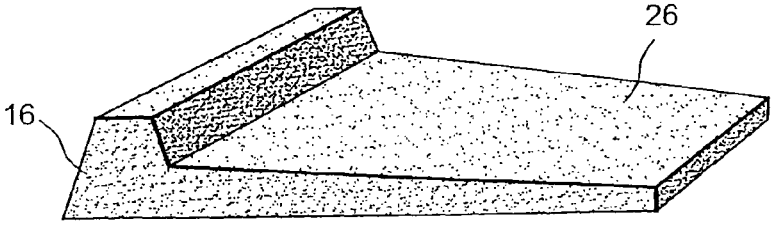
FIG. 3D BACKGROUND ART

Document U.S. Pat. No. 5,636,440 discloses such a technique shown diagrammatically in FIG. 3: upset forging operations (FIG. 3B) are carried out on a bar 30 with appropriate dimensions to make the primary parts 26, to force material into large volume areas 32 that will be used for example to form the root portion 16 of the primary part 26. The upset forged bar 30*b* will then be forged to obtain the primary part itself.

Conventionally, the upset forged bar 30*b* is forged in two steps due to the forces involved and the corresponding required power: the press firstly forms a blank 34 starting from a first die (forging the blank or <<first stamping>>, FIG. 3C), which distributes the material so as to limit the final forging force. The <<finish forging>> (FIG. 3D) with a second die creates a primary part 26 that is almost plane on both surfaces and that can then be machined to form the blade, for example by SPF/DB. The dies correspond to the shape of the parts obtained, in other words their shape is complementary to the shape of the blank 34 or the primary part 26.

Despite the use of two forging steps, a person skilled in the art finds it physically impossible to increase the dimensions of fabricated parts without making them significantly thicker: the power necessary to forge a plate increases almost exponentially with the width of the plate for constant thickness, in other words for a given plate size, the press needs to apply a force that increases exponentially with decreasing thickness of the plate.

In particular considering large diameter fans developed for wide body aircraft, the die forging technique reaches its limits because the dimensions of primary parts may for example be doubled. Since the thickness remains low, and particularly less than one centimeter, the thickness to width ratio for primary parts becomes too large; the power necessary to apply the forging force then is incompatible with cost effective operation. And sometimes mechanical presses capable of doing the work are not even on the market.

For example, the length L of the airfoil 4 may be of the order of 1 m to 1.2 m, for a width l of the order of 500 mm to 700 mm, for example 600 mm. It is quickly found that the thickness to width ratio e/l of the airfoil portion 14 of the primary part 26 can be as low as e/l=0.02 if it is required to limit the costs of raw material and final machining for a blade 1 with a conventional profile; this result cannot be achieved even with a capacity of the order of 15 000 t. Mechanical presses with a capacity of 16 000 t are exceptional and there are very few such machines currently available anywhere in the world. It does not seem physically or economically feasible to design a mechanical press with a much higher power and capable of making the parts mentioned above.

Hydraulic presses could undoubtedly supply the required power; however, they are slow (of the order of 10 s for die forging), which requires cooling of the material to be forged and would require the use of hot dies. Once again, the cost would be unacceptable.

The invention discloses a method wherein the external primary part is forged in several finishing operations by forging with distinct dies. Thus, the primary part can correspond to the model created first, for example by CAD, and the initial masses of the material involved and the number of machining operations are reduced. Furthermore, it is possible to use industrially proven forging methods, and particularly existing presses, which limits costs.

Finishing operations are done by forging with complementary dies, in other words the forging pressure is applied to each portion of the primary part once for finishing, but several steps are necessary to forge the different portions. However, although the primary part made using the method according to the invention is made in several steps, it does not require any significant additional machining for finishing its surface compared with a primary part made in a single stamping.

Figure 4A:
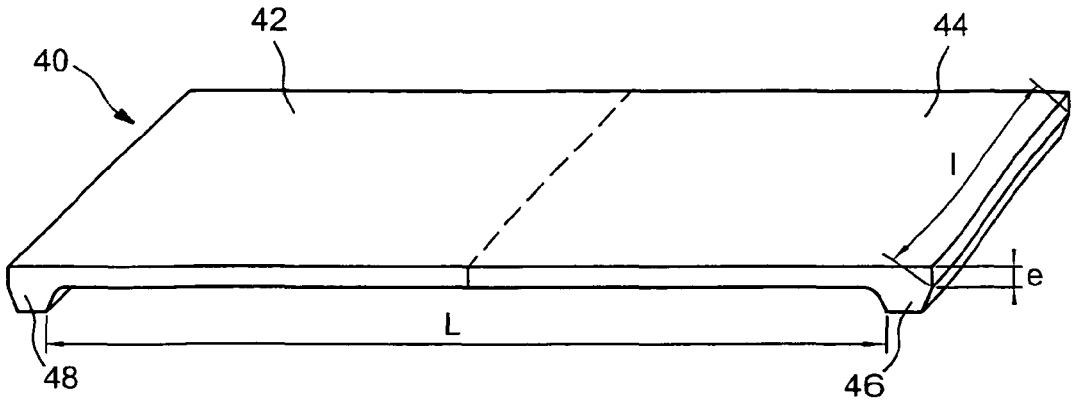

Several portions of the primary part 40 are thus defined arbitrarily, as shown in FIG. 4A showing a primary part 40 as manufactured by a method according to the invention. In FIG. 4A, a first portion 42 and a second portion 44 correspond to a half of the primary part 40 along the direction of its length L. According to the invention, the forging die will apply an action on one of the portions 42, 44 and then the other. Advantageously, considering the dimensions used for large fan blades, the primary part 40 comprises a second protuberance 46 at its far end from the root part 48. This protuberance 46 limits the longitudinal expansion during the forging phase; its volume is preferably less than the root part 48 and it can easily be eliminated during the final machining. Except for these two parts, the primary part 40 is approximately in the form of a flat plate over at least 80% or even 90% of its surface.

Figure 4B:
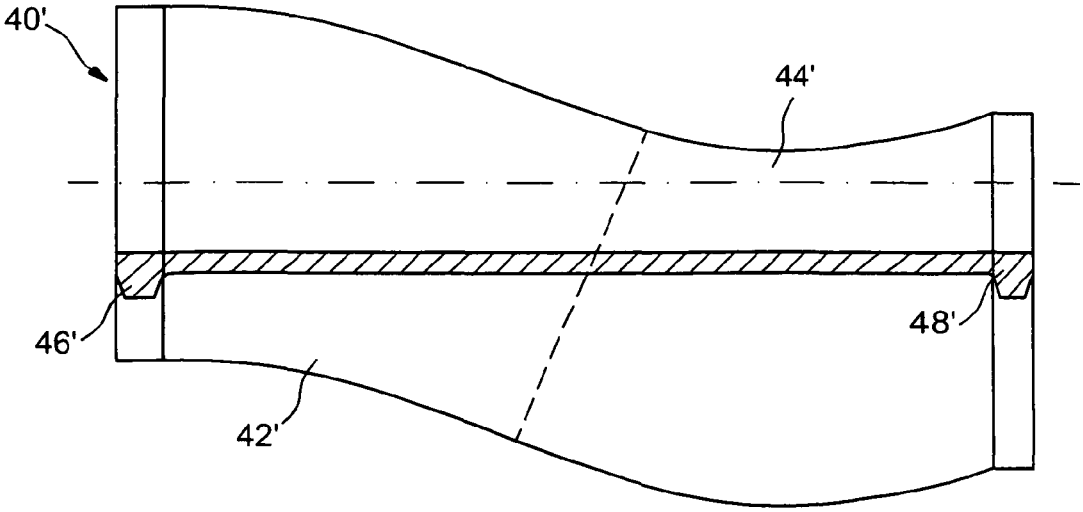

As shown diagrammatically in FIG. 4B, the primary part 40' can have a complex shaped surface, for example in the shape of a saber, and the protuberance 46' may be located in the first portion 42'. The portions 42', 44' are not necessarily defined perpendicular to the length L.

According to the invention and as shown in FIG. 3, the starting point for making the blank of the primary part 40 may be a bar made of a titanium alloy such as TiAlV with appropriate dimensions, for example a 1200 mm long and 100 mm diameter bar 30.

Advantageously, bars and their derivatives such as blanks are heated to a temperature of between 880° C. and 950° C., and the forming tool is heated to a temperature of between 200° C. and 300° C., throughout the duration of the process.

One of several conventional upset forging operations can be used to force material into large volume areas. Therefore in this case, upset forging operations can advantageously create two large volume areas for the protuberance 46 and the root part 48.

The next step consists of die forging the blank 50 shown diagrammatically in FIGS. 5A and 5B. The blank 50 is formed with trapezoidal or hexagonal shaped cross-sections as shown, in order to limit the forging force necessary for production; this minimizes friction forces and the dimensions $L_e$, $l_e$ obtained are optimum for the average thickness. Another possibility relates to ovoid cross-sections. As is well known, the die used in this step has a shape complementary to the shape of the blank 50, and is made using a conventional method.

The die dimensions, in other words the dimensions of the blank 50, are varied so as to use the maximum power of the envisaged press: the length $L_e$, width $l_e$ and thicknesses e, E are as close as possible to the dimensions of the primary part 40, while not exceeding the capacities of the press.

Figures 6B, 6C:
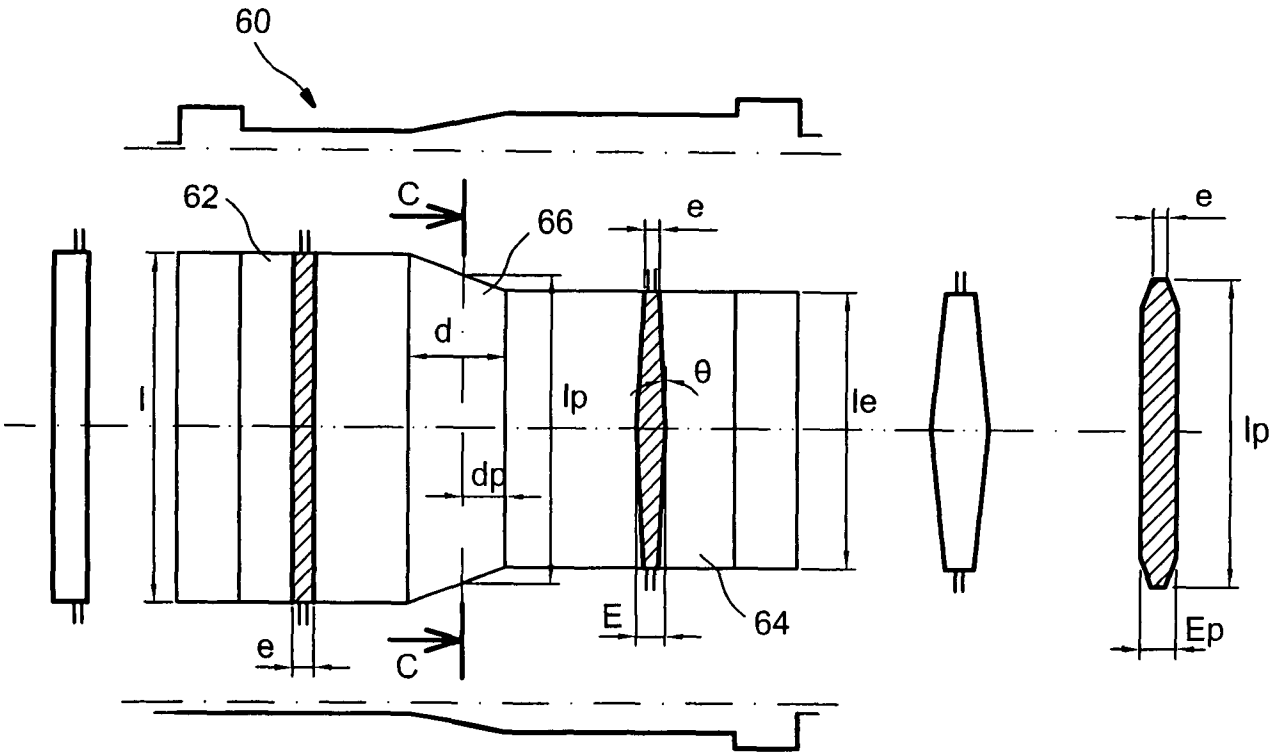
FIGS. 6B and 6C show the corresponding die.

The blank 50 is then forged a first time, using a first die defined so as to produce an intermediate part 52 (or intermediate blank) during the first stamping, as shown in FIG. 6A, comprising a first portion corresponding to the first portion 42 of the primary part 40, for example with the root part 48, and a second portion 54 corresponding to the blank that is not modified and will become the second portion 44 of the primary part 40. The first die 60 shown diagrammatically in FIG. 6B thus comprises a first portion 62 with a shape complementary to the first portion 42 of the primary part 40, and a second portion 64 complementary to the unmodified portion of the blank 54, in other words similar to the die used for forging the blank 50. The dimensions of the first portion 62 may be defined such that the forged surface (first portion 42 of the primary part) corresponds to the maximum power of the press used.

A second stamping consists of forging the portion left as a blank 54, so as to obtain a primary part 40 as defined in advance after this second finish forging, for which the thickness/width ratio is such that the material used and the final machining of the blade are reduced. The die used for this step corresponds to the final part 40.

In general, two steps are sufficient for the finish forging for large blades. However, these steps can be repeated n times if necessary due to the dimensions of the part to be forged, with n−1 intermediate blanks.

Thus the finish dies 60, except for the last die that corresponds to the primary part, comprise a first part 62 with a shape complementary to the primary part 40 (in other words plane except for the root portion 48 and the reinforcing protuberance 46) and on which pressure will be applied, and a second part 64 corresponding to the blank 50, for example with an ovoid or a trapezoidal shape, which will not transmit press forces to the metal of the forged part.

There is a connection area 66 between the first part 62 and the second part 64 of the die 60, for which the profile is determined so as to enable a <<smooth>> or burr free fillet connection between the different portions 42, 44 of the primary part 40, and thus to minimize machining costs.

In particular, the connection area 66 is shown diagrammatically in FIGS. 6B and 6C: surprisingly, calculations and experience have shown that the connection area 66 between a trapezoidal or hexagonal cross-section of the blank 64 and a finished portion in the form of a flat plate 42 is linear in thickness and in width, or forms a gradient.

Thus for example, for a primary part in the form of a plate 42 with width 1 and thickness e, the trapezoidal section is such that $l_e=\alpha l$, and $E=e(2-\alpha)/\alpha$, where $l_e$ is the width of the blank and E is the thickness of the blank at the thickest location, where $\alpha$ is a shape factor usually taken to be between 0.5 and 0.9.

In the connection area 66 with length d, the connection width is equal to $l_p$ and the thickness is between e and $E_p$ at all points at a distance $d_p$ from the blank 64. The cross-section of the blank will be maintained and a progressive connection will be obtained by respecting the following equations:

$$l_p=l_e+2\Delta l$$

$\Delta l=d_p(l-l_e)/2d$, where $d=0.15(l+l_e)$, 0.15 being an arbitrary shape factor $$\tan\theta=(E-e)/l_e$$

$(E-E_p)^2=E_p(4.\Delta l.\tan\theta)$, E and $4\Delta l.\tan\theta$ being constant.

For example, the values given in the following table could be chosen:

e = 5 mm; $\alpha$ = 0.7; l = 250 mm; $\theta$ = 1.4°; $l_e = \alpha.l$ = 175 mm; d = 0.15 $(l + l_e)$ = 63.75 mm

| $d_p$ | 10 | 20 | 30 | 40 | 50 | 60 |
|---|---|---|---|---|---|---|
| $E_p$ | 7.2 | 6.5 | 6.3 | 5.6 | 5.3 | 5 |
| $\Delta l$ | 6.25 | 12.5 | 18.75 | 25 | 31.25 | 37.5 |

Figure 7A:
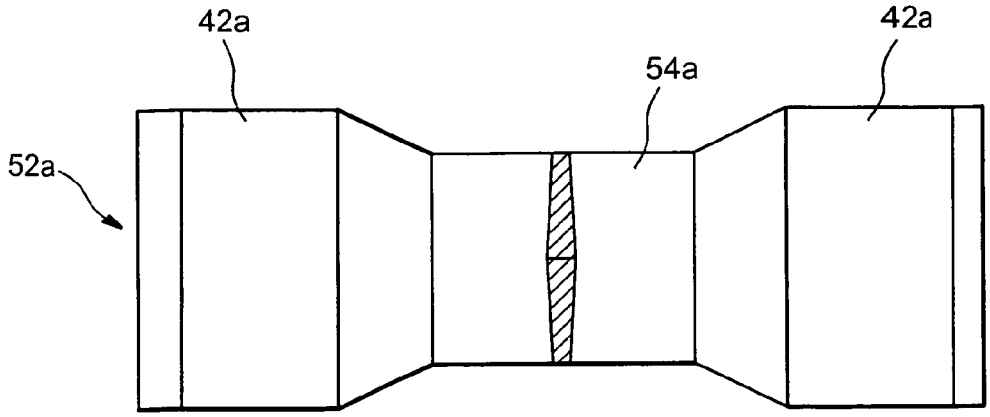
FIGS. 7A and 7B show alternate profiles of the die according to the invention.
Figure 7B:
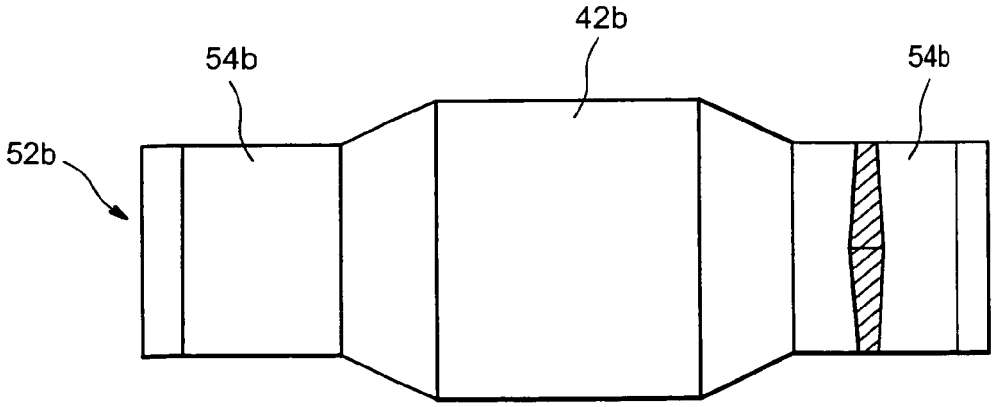

The configuration shown includes the first and second portions 42, 44 of the primary part 40, each showing half of the primary part in the longitudinal direction, but other configurations are possible. Thus for example, the die configurations shown in FIG. 7 could be envisaged. Similarly, three dies could be envisaged for three finish stampings.

Once complete, the external primary parts 26, 28 are assembled into a preform 14 and are fixed together, depending on the size of the blade, the loads that will be applied to it, etc., with a primary support part generally in the form of a plate inserted between the parts and designed to stiffen the hollow structure. Advantageously, the parts are assembled by diffusion bonding. The preform 14, possibly with its aerodynamic profile, is then machined to obtain a blade 1. Preferably, this step is carried out by inflation by gas pressure and superplastic forming according to conditions known in the SPF/DB technique.

Therefore, with the method according to the invention, it is possible to make a large blade and blade preform with machining equipment configured for smaller blades. More generally, with the method according to the invention, it becomes possible to use an existing press to make a plate larger than would be possible based on the nominal capacity of the press, for example twice as large.

The invention claimed is:

1. A method for manufacturing a hollow blade for a turbomachine, comprising a root and an airfoil, said method comprising:

producing at least a first external primary part having a final geometry and comprising a first portion having a root part and a second portion, the producing comprising providing the first primary part having an initial geometry of a blank, finish forging the first primary part using a press thereby forming a protuberance on the first primary part, and removing the protuberance to form the first external primary part having the final geometry, the finish forging including at least two subsequent and complementary forging steps for the first portion and then the second portion of the first primary part using at least a first finish die during a first of the two subsequent and complementary forging steps, the first finish die being composed of a single piece and comprising a first part complementary to the first portion of the first primary part and a second part complementary to the initial geometry of the blank, and a second finish die during a second of the two subsequent and complementary forging steps, the second finish die corresponding to the final geometry of the first external primary part; and diffusion bonding the first external primary part and a second external primary part to make a blade preform, the blade preform including an airfoil portion and a root portion.

2. The method according to claim 1, wherein the press is a mechanical press.

3. The method according to claim 1, comprising die forging of the blank from a bar, before finish forging.

4. The method according to claim 3, wherein the press used for forging the blank and for each finish forging step is the same.

5. The method according to claim 4, wherein the first and second external primary parts are produced the same way.

6. The method according to claim 4, wherein the diffusion bonding of the first and second external parts is followed by inflation by gas pressure and superplastic shaping of the preform.

7. The method according to claim 1, wherein the blank includes a trapezoidal, hexagonal or ovoid cross-section.

8. The method according to claim 1, wherein at least 90% of the first primary part submitted to the finish forging in two subsequent and complementary forging steps includes substantially a form of a flat plate with a thickness for which the thickness to width e/l ratio is less than 0.025, forging taking place in a thickness direction.

9. The method according to claim 1, comprising producing a third primary support part, the preform being composed of the first and second external primary parts surrounding the third primary support part.

10. The method according to claim 1, wherein a length of the airfoil of the hollow blade is about 1 m to 1.2 m and a width of the airfoil of the hollow blade is about 500 mm to 700 mm.

11. The method according to claim 1, wherein only the first finish die is used during the first of the two subsequent and complementary forging steps.

12. The method according to claim 1, wherein only the second finish die is used during the second of the two subsequent and complementary forging steps.

13. The method according to claim 1, wherein the first finish die comprises a connection area between the first part and the second part of the first finish die, which defines a gradient.

14. The method according to claim 13, wherein the connection area is linear in thickness and in width between the first part and the second part of the first finish die, so as to present the gradient.

15. A method for manufacturing a hollow blade for a turbomachine, comprising a root and an airfoil, said method comprising:

producing first and second external primary parts, each of the first and second primary parts having a final geometry and comprising a first portion and a second portion, the first portion of the first primary part including a root part, the producing comprising providing the first and second primary parts, each having an initial geometry of a blank, finish forging each of the first and second primary parts using a press thereby forming a protuberance on the first primary part, and removing the protuberance to form the first external primary part having the final geometry, the finish forging including at least two subsequent and complementary forging steps for the first portion and then the second portion of each of the first and second primary parts using at least a first finish die during a first of the two subsequent and complementary forging steps, the first finish die being composed of a single piece and comprising a first part complementary to the first portion of the first or second primary part and a second part complementary to the initial geometry of the blank, and a second finish die during a second of the two subsequent and complementary forging steps, the second finish die corresponding to the final geometry of the first or second external primary part;

diffusion bonding the external primary parts to make a blade preform; and machining the preform by an inflation by gas pressure and superplastic shaping to obtain the hollow blade.

16. The method for manufacturing according to claim 15, wherein the press used for each finish forging step of both the first and second primary parts is the same and is a mechanical press.

17. A method for manufacturing a hollow blade for a turbomachine, comprising a root and an airfoil, said method comprising:

producing at least a first external primary part having a final geometry and comprising a first portion having a root part and a second portion, the producing comprising providing the first primary part having an initial geometry of a blank, finish forging the first primary part using a press thereby forming a protuberance on the first primary part, and removing the protuberance to form the first external primary part having the final geometry, the finish forging including at least two subsequent and complementary forging steps for the first portion and then the second portion of the first primary part using at least a first finish die during a first of the two subsequent and complementary forging steps, the first finish die being composed of a single piece and comprising a first part complementary to the first portion of the first primary part, a second part complementary to the initial geometry of the blank, and a connection area between the first part and the second part of the first finish die, which defines a gradient, and a second finish die during a second of the two subsequent and complementary forging steps, the second finish die corresponding to the final geometry of the first primary part; and diffusion bonding the first external primary part and a second external primary part to make a blade preform, the blade preform including an airfoil portion and a root portion.

* * * * *